US005791733A

United States Patent [19]

van Hekken et al.

[11] Patent Number: 5,791,733

[45] Date of Patent: Aug. 11, 1998

[54] ADJUSTABLE LUMBAR SUPPORT

[75] Inventors: Hendrik R. van Hekken, Allentown; Gordon L. Branin, Jr., Pennsburg, both of Pa.

[73] Assignee: Knoll, Inc., East Greenville, Pa.

[21] Appl. No.: 879,473

[22] Filed: Jun. 20, 1997

Related U.S. Application Data

[63] Continuation of Ser. No. 599,019, Feb. 9, 1996, abandoned.

[51] Int. Cl.[6] ..... A47C 7/46

[52] U.S. Cl. ..... 297/284.4; 297/284.7; 297/452.31

[58] Field of Search ..... 297/284.1, 284.4, 297/284.7, 452.31

[56] References Cited

U.S. PATENT DOCUMENTS

| | | | |
|---|---|---|---|
| 2,756,809 | 7/1956 | Endresen | 297/284.7 |
| 2,942,651 | 6/1960 | Binding . | |
| 3,948,558 | 4/1976 | Obermeier et al. | 297/284.4 |
| 4,316,631 | 2/1982 | Lenz et al. . | |
| 4,425,910 | 1/1984 | Meiller . | |
| 4,452,485 | 6/1984 | Schuster . | |
| 4,556,251 | 12/1985 | Takagi . | |
| 4,576,410 | 3/1986 | Hattori . | |
| 4,632,454 | 12/1986 | Naert . | |
| 4,690,456 | 9/1987 | Chiba et al. | 297/284.6 |
| 4,730,871 | 3/1988 | Sheldon | 297/284.7 X |
| 4,811,986 | 3/1989 | Hattori et al. . | |
| 4,909,568 | 3/1990 | Dal Monte . | |
| 5,013,087 | 5/1991 | Nagasaka . | |
| 5,088,790 | 2/1992 | Wainwright et al. . | |
| 5,101,811 | 4/1992 | Brunswick . | |
| 5,197,780 | 3/1993 | Coughlin | 297/284.4 |
| 5,217,278 | 6/1993 | Harrison et al. | 297/284.7 |
| 5,320,412 | 6/1994 | Eakins et al. . | |
| 5,403,069 | 4/1995 | Inara et al. | 297/284.4 |
| 5,423,593 | 6/1995 | Nagashima | 297/284.4 |
| 5,449,219 | 9/1995 | Hay et al. | 297/284.4 |
| 5,474,358 | 12/1995 | Maeyaert | 297/284.7 |

*Primary Examiner*—Peter M. Cuomo
*Assistant Examiner*—Anthony D. Barfield
*Attorney, Agent, or Firm*—Buchanan Ingersoll, P.C.

[57] ABSTRACT

A chair back has a user-positionable lumbar support plate, movable vertically along the back to position the support in an area between a padding panel and a backpan of the chair back. The lumbar support plate is mounted on a pin-and-slot track, and protrudes forwardly to bear against the padding panel to provide a protrusion or relatively harder section in the chair back at the chosen height. Cable-in-conduit control lines are attached to the lumbar plate and to a manual control such as a pivoting handle on the chair seat, in a closed loop whereby the handle positively positions the lumbar plate in a push-pull arrangement. A low friction sheet material is disposed between the lumbar plate and the padding panel for free sliding, and can be attached to the backpan above the range of travel of the lumbar plate. A series of spaced stops are associated with the control handle for fixing the vertical position of the lumbar plate.

22 Claims, 6 Drawing Sheets

ADJUSTABLE LUMBAR SUPPORT

This application is a continuation of application Ser. No. 08/599,019 filed Feb. 9, 1996 now abandoned.

BACKGROUND OF THE INVENTION

1. Field of the Invention

The invention relates to the field of chairs with user operated controls for reconfiguring the contour of the chair to suit the user's anatomy and/or comfort. In particular the invention concerns an adjustable lumbar support for a chair, having a dual cable mechanism with a single control lever in a push-pull arrangement for vertically positioning a forwardly protruding shaped plate along a sliding sheet disposed behind the padded backing of a chair.

2. Prior Art

Person's of any size may sit in a chair of a given size, and it is advantageous to allow the user of a chair to make various adjustments to suit the chair to the user. Such adjustments often include adjustments in height, tilt of the back or seat portion, resilience to tilting, etc. One known adjustment is the deployment and/or positioning of a lumbar support. The lumbar support can comprise a rounded protrusion directed forward from the surface of the lower back portion of the chair, and/or a means for rendering the back of the chair less compressible in the lower back area than in other areas.

The lumbar region is an anterior curve in the lower part of the spine near the person's waist. The vertical position of this curve varies with the height of the user. The lumbar curve is generally deeper in females and shallower in males. The five lumbar vertebrae are the largest of the vertebrae and have thick spinous processes at which powerful back muscles are attached. Good support in the lumbar area prevents fatigue and leads to comfort and good posture. However a protrusion that is not placed properly for the user, for example being placed too high so as to engage the posterior curve in the thoracic region of the spine, can be quite uncomfortable. Therefore, one useful adjustment is in the height of the lumbar support.

Whereas the lumbar support employs a forward protrusion, there are several possibilities for adjusting mechanisms that can control the height and/or the extent of forward protrusion. Known lumbar supports frequently involve a member on a horizontal pivot axis that can be turned either to retract a padded member (or a padding-contacting internal member) back into the seat back, or to advance the member forward for added pressure against the user in the lumbar region. Another approach is to provide means for applying tension to vary the radius of curvature of supporting ribs in the chair or in a lumbar support, either against spring tension or against the resilient tendency of the ribs to straighten. Insofar as such a support relies on spring tension or the resilience of ribs, the user must exert more effort to move the control when substantially displaced than when near the rest position of the device, due to the spring constant. In addition, such devices are relatively complicated and therefore expensive.

A lumbar support mechanism should be substantially internal to the chair. Any protrusion should be drivable positively yet easily by the user and should remain fixed wherever it is placed. Preferably the action is smooth and does not result in a great deal of wear. Although a number of pivotable or otherwise movable lumbar support devices are known, achieving all these objectives in an optimally simple, durable and cost effective manner remains to be accomplished.

SUMMARY OF THE INVENTION

It is an object of the invention to provide an effective vertically movable lumbar support for a chair with a minimum of mechanical complications and so as to provide a positive and smoothly operable device.

It is another object of the invention to provide a generally triangular forward protrusion slidably movable over a vertical span in a push-pull arrangement in a chair back.

It is a further object to provide a movable lumbar support protrusion on a relatively rigid backpan behind a flexible chair back panel and to face the internal wall of this chair back panel with a free sliding material such that the lumbar support is freely movable.

It is still another object in a lumbar support device as described to provide spaced cable-in-conduit mountings on the backpan coupling the movable support protrusion by a dual cable to a lever control on the opposite ends of the dual cables, the lever control having discrete position stops for positively setting the vertical position of the movable support.

These and other objects are accomplished by a chair with a chair back having a user-positionable lumbar support plate, movable vertically along the back to position the support in an area between a padding panel and a backpan of the chair back. The lumbar support plate is mounted on a pin-and-slot track, and protrudes forwardly to bear against the padding panel to provide a protrusion or relatively harder section in the chair back at the chosen height. Cable-in-conduit control lines are attached to the lumbar plate and to a manual control such as a pivoting handle on the chair seat, in a closed loop whereby the handle positively positions the lumbar plate in a push-pull arrangement. A low friction sheet material is disposed between the lumbar plate and the padding panel for free sliding, and can be attached to the backpan above the range of travel of the lumbar plate. A series of spaced stops are associated with the control handle for fixing the vertical position of the lumbar plate.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
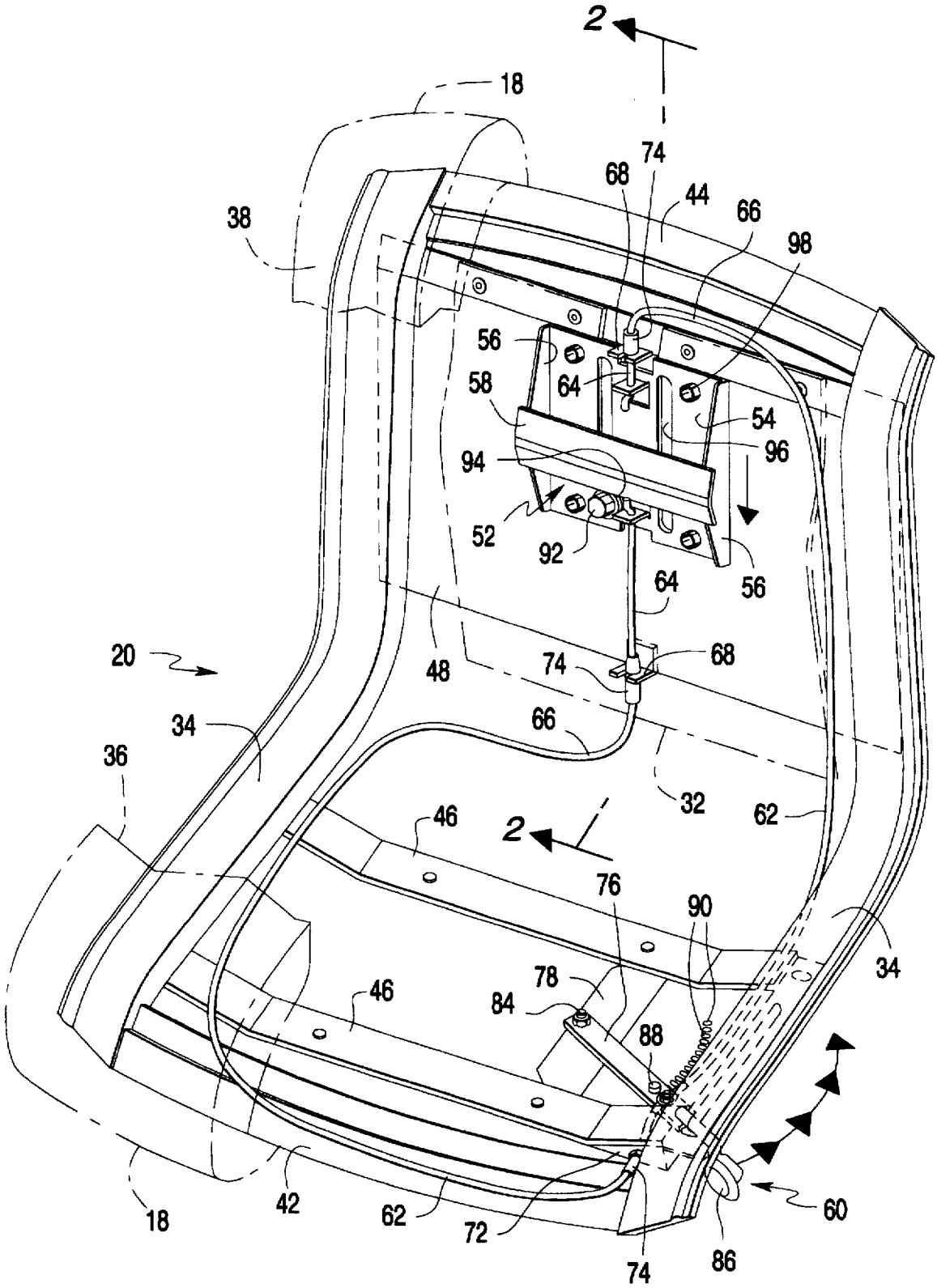
FIG. 1 is a partially cut-away perspective view of a chair with movable lumbar support according to the invention.

In FIG. 1, the external padding material 18 of a chair 20 according to the invention is cut away or shown in broken lines to show the chair frame, as is the low friction lumbar sheet 32, which is discussed below. The chair 20 as shown comprises frame rails 34 on the lateral edges determining the generally horizontal and vertical contour of the chair seat 36 and chair back 38, respectively. The frame rails 34 can be made of formed steel. The frame rails are connected by cross members welded thereto, including a front seat edge cross member 42 and a top back edge cross member 44. These edge cross members 42, 44 can be made, for example, of sheet metal that is rolled over into a curved channel at the outer edge to provide a smooth curve for the chair padding material or upholstery 18 at the edges, and also can provide points at which the padding material can be affixed to the frame, as shown cross sectionally in FIG. 2. The padding material 18 generally comprises a formed panel of resilient material such as foamed urethane, and is faced externally with a plastic, leather or fabric sheet (not shown) in known manner. The resilient core is generally about one inch (2.5 cm) thick, but may be thicker or thinner.

The edge rails 34 are also coupled by generally horizontal bars 46, of which more or fewer are possible, two downwardly curved seat bars 46 defining a seat depression and generally supporting the seat 36 from underneath. The seat bars 46 and/or the frame rails 34 are affixed to a wheeled pedestal or to legs (not shown) that support 36 seat at a distance above the floor.

The chair 20 shown in the drawings is a relatively low-backed chair, for example a workstation chair, desk chair or the like. It will be appreciated that the invention is also applicable to chairs of other proportions, for example executive chairs having relatively higher backs, as well as other forms of chairs.

In addition to bars 46 bridging between the frame rails, a backpan 48 is coupled between frame rails 34 at least in the lumbar area of chair 20, and provides a stationary base for a lumbar plate structure 52 that is movable up and down on backpan 48 to accommodate the anatomy and comfort of users. Backpan 48 can be a relatively rigid sheet metal panel connecting frame rails 34. The backpan in the embodiment shown is flat to accommodate the flat base 54 of the lumbar plate structure 52, but could be curved to accommodate a complementary curved lumbar plate base as well.

Figure 2:
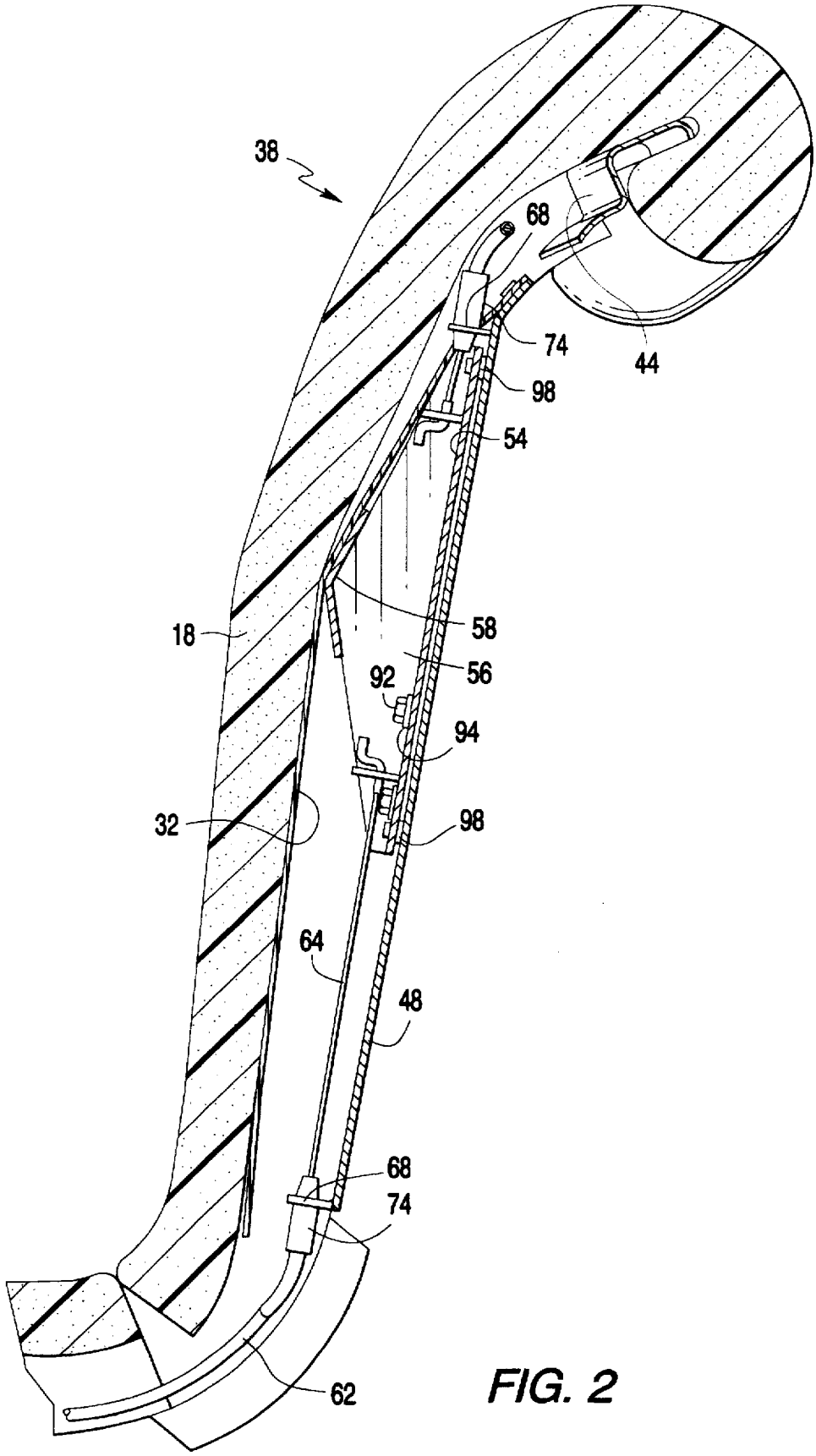
FIG. 2 is a section view along lines 2—2 in FIG. 1.

The base portion 54 of lumbar plate 52 comprises a sheet metal portion with end walls 56 that are triangular or curved, a triangular arrangement being shown in FIG. 2. The end walls 56 can be integral with the portion of base 54 that bears against the backpan 48, and are bent upwardly to provide a mounting for a horizontally elongated lumbar support bar 58 that is affixed to the end walls 56 at a distance above the lumbar plate base 54. In the embodiment shown, bar 58 comprises an angle iron forming an obtuse angle in section, but the bar could also form a smooth curve. Whereas bar 58 bears forwardly toward the user through the relatively thick padding material 18, the angle iron shape shown nevertheless produces a smooth curve or bulge in the padding material 18 at the height of bar 58.

Figure 3:
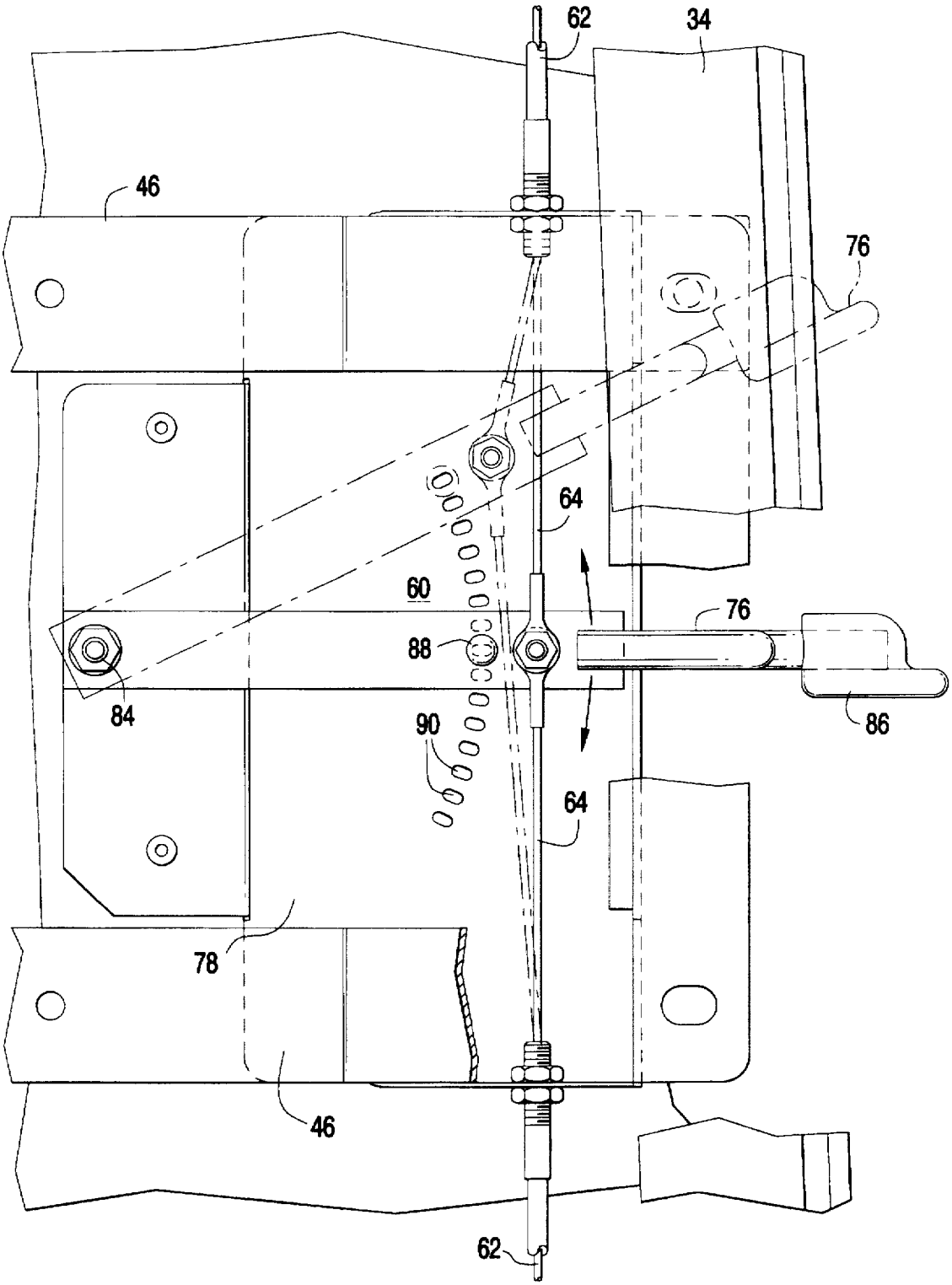
FIG. 3 is a partial plan view showing the structure and operation of the manual control handle according to a preferred embodiment.
Figure 4B:
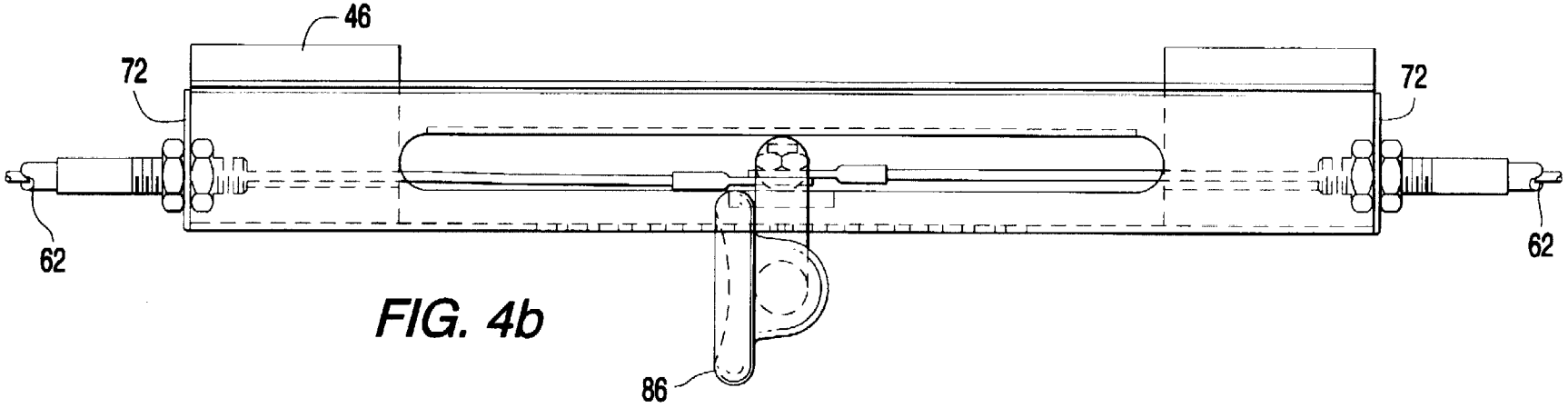
FIG. 4*b* is a partial side elevation view corresponding to FIG. 4*a*.
Figure 4A:
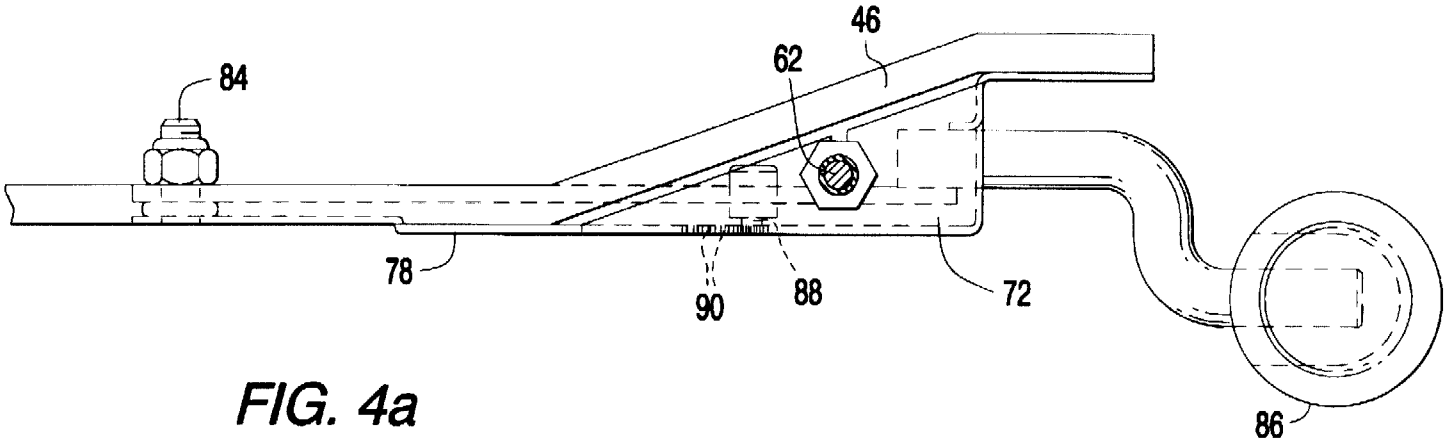
FIG. 4*a* is a partial front elevation view showing the control handle and cable connections.
Figure 5:
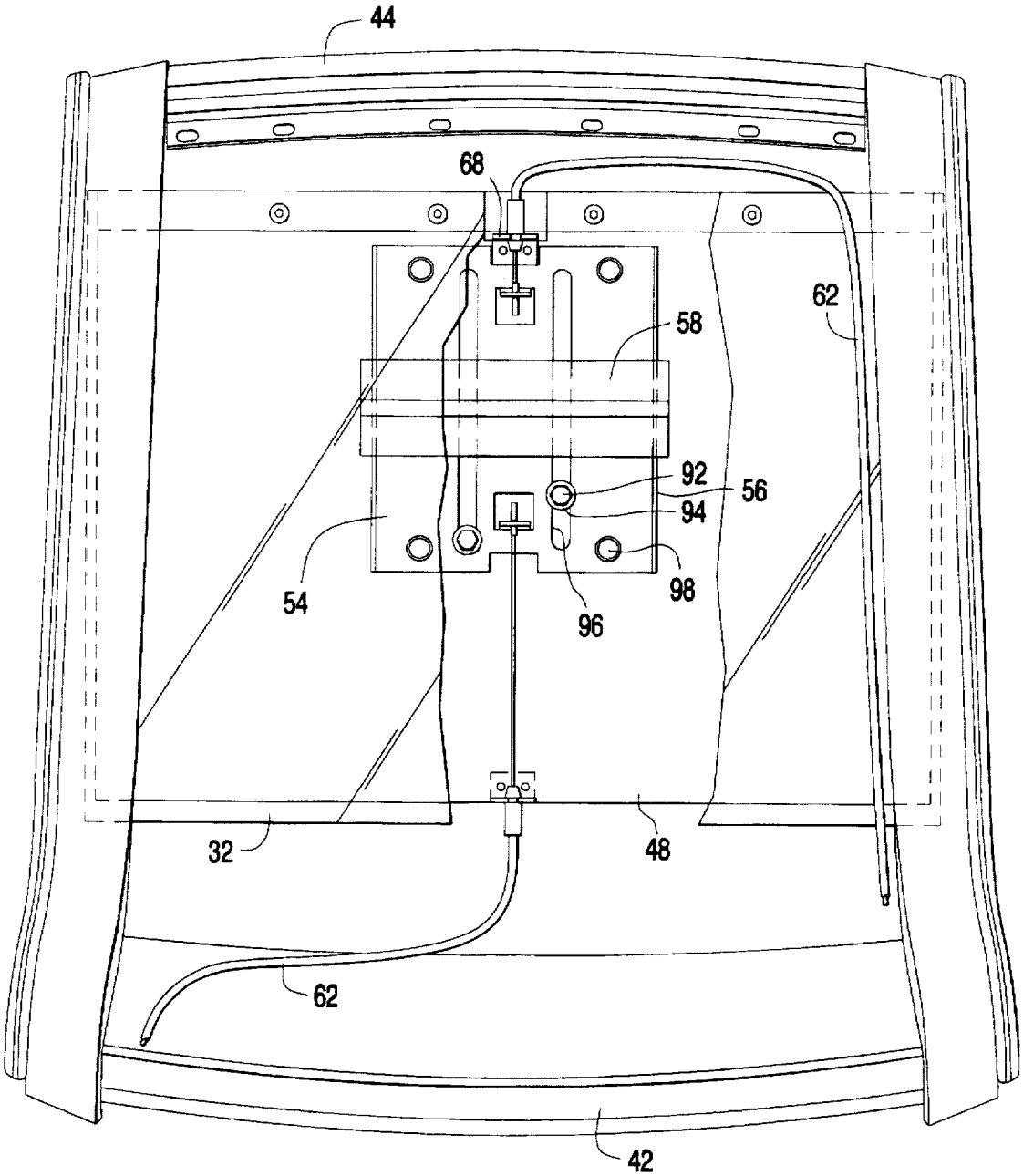
FIG. 5 is a front elevation view showing the movable lumbar plate near its upper extreme of travel.

The lumbar support structure 52 is vertically adjustable using a manual control 60, shown generally in FIG. 1 and in detail in FIGS. 3, 4*a* and 4*b*. More particularly, lumbar support 52 is disposed between the rigid backpan 48 and the flexible panel of padding material 18, and is movable vertically on backpan 48 while protruding forward to bear against padding panel 18. In this manner the user can adjust the lumbar plate or support 52 to rest comfortably at the desired point along the lumbar curve of the spine, supporting the user and improving comfort and posture. For controlling the position of lumbar plate 52, control cables 62 are coupled to lumbar plate 52 and are operable to exert tension on the lumbar plate in vertically opposite directions. In the embodiment shown, a manual lever control is coupled to first and second control cables 62, such that movement of the control handle in opposite directions moves lumbar plate 52 in either of the vertically opposite directions between it extremes of travel, shown in FIGS. 5 and 6.

According to the invention lumbar plate 52 does not bear directly against padding material 18 from the rear. A low friction flexible sheet material 32 is disposed between the lumbar plate 52 and the padding panel 18, such that lumbar plate 52 slides freely along the padding panel. The sheet 32 can comprise a smooth plastic such as medium density polyethylene, polytetrafluoroethylene (Teflon), etc., or can comprise a flexible sheet metal or foil panel or another material presenting a low friction surface to lumbar plate 52. The sheet 32 is attached to backpan 48, for example by rivets, above the upper limit of travel of the lumbar plate, for example at the upper edge of backpan 48. The lower edge of sheet 32 hangs free.

The opposed first and second control cables 62 coupled between lumbar plate 52 and the manual control 60 preferably comprise cables in conduits, such as Bowden cables, braided conduit or long lay conduit cables, etc. Each has a wire or cord line 64 in a sleeve 66. The lines can comprise cords or solid or stranded wire, and preferably are stranded multifilament wire. By using cables in conduits or sleeves, the control cables 62 need not be taut between lumbar plate 52 and the control 60, and can be routed along the edges of seat 36 and chair back 38 to a convenient point for control 60, such as under a lateral edge of seat 36. Cables-in-conduits are also advantageous in application of the invention to chairs in which the back and seat are in one piece as well as chairs in which the back and seat are simply attached.

First fixed mountings 68 on backpan 48 above and below the limits of travel of lumbar plate 52 affix the conduits or sleeves 66 of the control cables relative to backpan 48, and second fixed mountings 72 attached to the frame of the seat affix sleeves 66 adjacent to the corresponding limits of travel of the manual control. The wires or cores of the control cables attach to the lumbar plate 52 at raised flanges, and to the movable manual control handle 76. Moving the control in either direction thus drives the lumbar plate 52 up or down in a push-pull arrangement using both cables 62.

In the embodiment shown, two discrete control cables are provided in an opposed manner. Whereas each exerts tension in its respective direction, the cables can also be considered a pull-pull arrangement, strictly speaking. Provided that appropriate spaces are provided along sleeve 66 of control cable 62, a similar pull-pull function can be achieved by making the control cable wire continuous at one or both of control handle 76 and lumbar plate 52, and attached to both, e.g., using clamping bolts, closed loops, knots or the like (not shown). A strict push-pull arrangement is also possible, for example using a single solid core cable.

The fixed mountings for the sleeves of the control cables can comprise simple stops having openings large enough to pass wire 64 but not sleeve 66. Preferably however as shown in FIGS. 1 and 3, end cups 74 are provided to receive the ends of sleeves 66. The end cups 74 can have annular slots that snap into flanges attached to the frame, such as flanges 68 on backpan 48 in FIG. 1. Alternatively the end cups 74 can be threaded and securely attached to flanges on the frame by opposed nuts as shown on bars 46 in FIG. 3. Referring to FIGS. 4*a* and 4*b*, cables 62 can be attached to the handle 76 of the manual control at a common bolt 84.

In FIG. 3, manual control 60 comprises a movable handle 76 mounted to an actuator plate 78 that is attached to the chair seat 36 and forms the flanges for supporting the ends of cable sleeves 66. A slidable handle member is possible, but a handle member pivoted on a bolt 84 in actuator plate 78 is provided in the embodiment shown. The handle member 76 includes an actuator arm that generally comprises a flat metal bar, a lever that extends the handle, and preferably a knob 86 at the edge of seat 36 for grasping by the user. The actuator arm is urged to lay flat against actuator plate 78 by pivot bolt 84. The actuator arm carries a detent pin 88 that protrudes downwardly and engages in any of a plurality of spaced holes or stops 90 that are arranged in an arc around pivot bolt 84 to receive the pin. The holes or stops define incremental detent locations at which the actuator arm can be fixed when pin 88 fits into a corresponding hole or similar receptacle in actuator plate 78, thereby fixing a vertical position of the lumbar plate 52 along backpan 48. The detent pin 88 can be rounded and the stops can be formed by depressions sized to receive the protruding pin, such as punched holes in actuator plate 78. The pin and hole arrangement forms a clicking detent pattern of stops.

Figure 6:
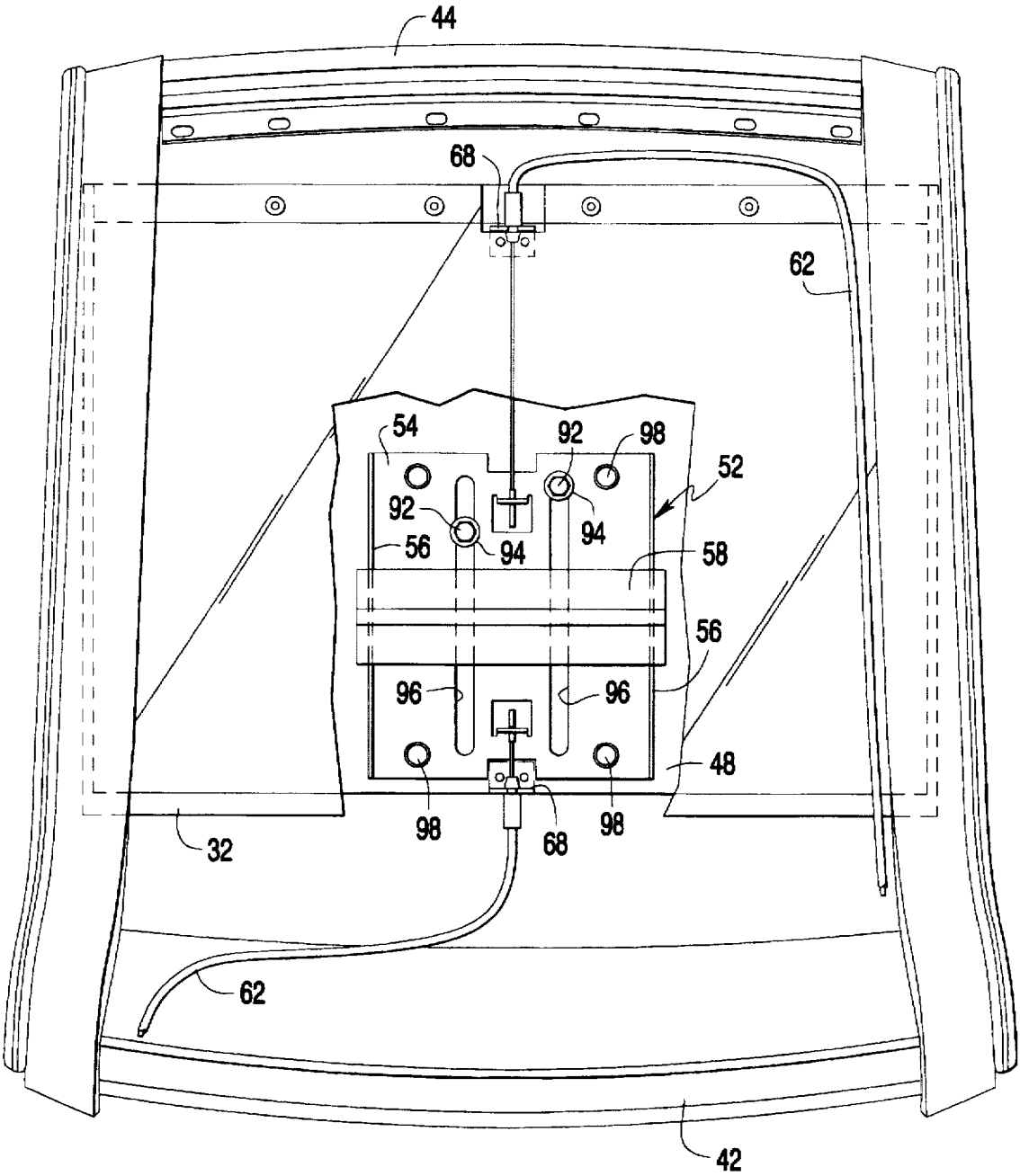
FIG. 6 is a front elevation view corresponding to FIG. 5 and showing the lumbar plate near its lower extreme of travel.

Lumbar plate 52 slides up or down along backpan 48 with minimal friction along a sliding track. In the embodiment shown, two bolts 92 having low friction nylon or plastic washers 94 attach lumbar plate 52 to backpan 48 at laterally spaced vertical guide slots 96. The two bolts 92 are at different vertical heights, which helps to maintain correct alignment of lumbar plate 52. The extent of travel is preferably about four inches (10 cm) between an upper extreme (FIG. 5) and a lower extreme (FIG. 6). The lumbar plate 52 is also provided with four nylon shoulder washers 98 that are press-fit in holes in the base of lumbar plate 52 and limit the area of surface with backpan 48 to the area of contact of the shoulder washers, further reducing friction.

Lumbar plate 52 slides freely between backpan 48 and the facing flexible sheet 32, the sheet not only reducing friction but also minimizing wear on the foamed polymer padding material 18. As a result, it is easy and convenient for the user of the chair to place lumbar plate 52 at the desired position in its span of movement, for example to an incremental spacing determined by the detent pin, of about a quarter inch (0.6 cm).

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A chair having a user-positionable lumbar support, comprising:

a chair seat and a chair back, the chair back having a backpan and a flexible padding panel disposed over the backpan;

a lumbar plate disposed between the backpan and the padding panel and protruding forward to bear against the padding panel, the lumbar plate being movable vertically on the backpan;

a pair of control cables coupled to the lumbar plate at opposite ends thereof and operable to exert tension on the lumbar plate so that the lumbar plate is movable in vertically opposite directions; and, a manual control coupled to the control cables, said manual control comprising a movable handle directly mounted to the chair seat, and further comprising a plurality of spaced stops fixing a position of the handle relative to the seat such that movement of the manual control in opposite directions moves the lumbar plate in either of the vertically opposite directions using both cables simultaneously.

2. The chair of claim 1, further comprising a low friction sheet of material disposed between the lumbar plate and the padding panel and affixed to an upper edge of the backpan, such that the lumbar plate slides freely along the padding panel.

3. The chair of claim 2 wherein one of the control cables is attached to an upper end of the lumbar plate and the other cable is attached to a lower end of the lumbar plate.

4. The chair of claim 1 wherein the handle is connected to the chair seat at a pivot and the stops comprise spaced receptacles for the handle, disposed in an arcuate pattern around the pivot.

5. The chair of claim 4 wherein the handle has a protrusion and the stops comprise depressions sized to receive the protrusion.

6. A chair having a user-positionable lumbar support, comprising:

a chair seat and a chair back, the chair back having a backpan and a flexible padding panel disposed over the backpan;

a lumbar plate disposed between the backpan and the padding panel and protruding forward to bear against the padding panel, the lumbar plate being movable vertically on the backpan;

a low friction sheet material affixed to the backpan at an upper edge thereof and disposed between the lumbar plate and the padding panel, such that the lumbar plate slides freely along the padding panel;

at least one control cable coupled to the lumbar plate and operable to exert tension on the lumbar plate so that the lumbar plate is movable in vertically opposite directions; and a manual control coupled to the control cable, said manual control comprising a movable handle directly mounted to the chair seat, and further comprising a plurality of spaced stops fixing a position of the handle relative to the seat such that movement of the manual control in opposite directions moves the lumbar plate in either of the vertically opposite directions.

7. The chair of claim 6, wherein the at least one control cable comprises first and second cables, each having a line in a sleeve, and further comprising first mountings affixing the sleeves of the cables relative to the backpan at opposite ends thereof.

8. The chair of claim 7, further comprising second mountings affixing the sleeves at fixed locations adjacent to the manual control.

9. The chair of claim 7, wherein the first cable is attached to an upper end of the lumbar plate and the second cable is attached to a lower end of the lumbar plate.

10. The chair of claim 6, wherein the handle is connected to the chair seat at a pivot and the stops comprise spaced receptacles for the handle, disposed in an arcuate pattern around the pivot.

11. The chair of claim 6, wherein the handle has a protrusion and the stops are formed by depressions sized to receive the protrusion.

12. A chair having a user-positionable lumbar support, comprising:

a chair seat and a chair back, the chair back having a backpan and a flexible padding panel disposed over the backpan;

a lumbar plate disposed between the backpan and the padding panel and protruding forward to bear against the padding panel, the lumbar plate being movable vertically on the backpan;

a low friction sheet material having an upper edge and a lower edge and disposed between the lumbar plate and the padding panel, the upper edge of the low friction sheet material affixed to an upper end of the backpan, such that the lumbar plate slides freely along the padding panel;

first and second control cables coupled to the lumbar plate and operable to exert tension on the lumbar plate so that the lumbar plate is movable in vertically opposite directions, each cable having a line in a sleeve, and further comprising first mountings affixing the sleeves of the cables relative to the backpan at opposite ends thereof, and second mountings affixing the sleeves at fixed locations adjacent to the manual control, wherein the first cable is attached to an upper end of the lumbar plate and the second cable is attached to a lower end of the lumbar plate; and a manual control coupled to the control cables, said manual control comprising a movable handle directly mounted to the chair seat, and further comprising a plurality of spaced stops fixing a position of the handle relative to the seat, for fixing a vertical position of the lumbar plate.

13. The chair of claim 12, wherein the handle is connected to the chair seat at a pivot and the stops comprise spaced receptacles for the handle, disposed in an arcuate pattern around the pivot.

14. The chair of claim 13, wherein the handle has a protrusion and the stops are formed by depressions sized to receive the protrusion.

15. The chair of claim 12, wherein the lumbar plate comprises a base slidable along the backpan and a horizontally elongated bar affixed to the base.

16. The chair of claim 15, further comprising a sliding structure engaging between the lumbar plate and the backpan.

17. The chair of claim 16, wherein at least one of the base and the backpan comprises a vertical slot, and further comprising a connecting pin disposed in the slot and coupled to the other of the base and the backpan.

18. The chair of claim 17, further comprising at least one washer disposed between the base and the backpan for limiting contact between the base and the backpan to an area of the washer.

19. The chair of claim 17, wherein the base has two vertical slots engaged by two connecting pins in the backpan.

20. The chair of claim 19, wherein the connecting pins are at different vertical heights in order to maintain correct alignment of the lumbar plate as the lumbar plate moves upwardly or downwardly, and further comprising a washer on each of the connecting pins.

21. A chair having a user-positionable lumbar support, comprising:

a chair seat and a chair back, the chair back having a backpan and a flexible padding panel disposed over the backpan;

a lumbar plate disposed between the backpan and the padding panel and protruding forward to bear against the padding panel, the lumbar plate being movable vertically on the backpan;

a low friction sheet material having an upper edge and a lower edge and disposed between the lumbar plate and the padding panel, the upper edge of the low friction sheet material affixed to an upper end of the backpan, such that the lumbar plate slides freely along the padding panel, a pair of control cables coupled to the lumbar plate at opposite ends thereof and operable to exert tension on the lumbar plate so that the lumbar plate is movable in vertically opposite directions wherein one of the control cables is attached to an upper end of the lumbar plate and the other cable is attached to a lower end of the lumbar plate; and a manual control coupled to the control cables, said manual control comprising a movable handle directly mounted to the chair seat at a pivot, and further comprising a plurality of spaced stops arranged on the seat and fixing a position of the handle relative to the seat, such that movement of the manual control in opposite directions moves the lumbar plate in either of the vertically opposite directions using both cables simultaneously.

22. The chair of claim 21 wherein the handle has a protrusion and the stops comprise depressions sized to receive the protrusion.

* * * * *